US007285193B2

(12) United States Patent
Robinson et al.

(10) Patent No.: US 7,285,193 B2
(45) Date of Patent: Oct. 23, 2007

(54) ENCAPSULATED CATHODE HANGER BAR AND METHOD OF MANUFACTURING

(75) Inventors: Victor Robinson, Port Sydney (CA); James Joseph Detulleo, Connaught (CA); Gordon S. Iverson, Oakville (CA); Ian J. Beales, Calgary (CA)

(73) Assignee: Falconbridge Limited, Sudbury, Ontario (CA)

( * ) Notice: Subject to any disclaimer, the term of this patent is extended or adjusted under 35 U.S.C. 154(b) by 0 days.

(21) Appl. No.: 10/518,147

(22) PCT Filed: Jun. 17, 2003

(86) PCT No.: PCT/CA03/00919

§ 371 (c)(1),
(2), (4) Date: Nov. 16, 2005

(87) PCT Pub. No.: WO03/106738

PCT Pub. Date: Dec. 24, 2003

(65) Prior Publication Data

US 2006/0102470 A1 May 18, 2006

Related U.S. Application Data

(60) Provisional application No. 60/389,452, filed on Jun. 18, 2002.

(51) Int. Cl.
*C25D 1/00* (2006.01)

(52) U.S. Cl. ..... 204/281; 204/286.1; 204/288; 204/288.2; 204/289

(58) Field of Classification Search ..... 204/279, 204/281, 286.1, 288, 288.2, 289
See application file for complete search history.

(56) References Cited

U.S. PATENT DOCUMENTS

| | | | | |
|---|---|---|---|---|
| 5,172,850 | A | 12/1992 | Prengaman et al. | |
| 5,492,609 | A | 2/1996 | Assenmacher | |
| 6,131,798 | A | 10/2000 | Prengaman | |
| 6,569,300 | B1 * | 5/2003 | Assenmacher | 204/286.1 |
| 6,746,581 | B2 * | 6/2004 | Ebert | 204/279 |

FOREIGN PATENT DOCUMENTS

| | | |
|---|---|---|
| CN | 2298264 Y | 11/1998 |
| DE | 42 41 485 | 9/1994 |
| EP | 0 301 115 | 2/1989 |
| JP | 63-57793 | 3/1988 |
| WO | 03/062497 | 7/2003 |

* cited by examiner

*Primary Examiner*—Bruce F. Bell
(74) *Attorney, Agent, or Firm*—Merchant & Gould P.C.

(57) ABSTRACT

A cathode for use in the refining or winning of metals, typically used in the electro-refining or winning of copper, comprising a substantially flat deposition plate fixedly attached along an upper edge thereof to an elongate hanger bar thereby defining a connection. A protective cladding is attached to the deposition plate and at least partially surrounding the hanger bar such that a cavity is defined in the region of the connection. A corrosion resistant material fills the cavity. In this manner the corrosion resistant material prevents corrosive substances from penetrating the connection. The corrosion resistant material prevents corrosive electrolytic solution and other liquids from corroding the conductive connection between the deposition plate and the hanger bar which would otherwise reduce efficiency of the cathode.

12 Claims, 2 Drawing Sheets

ENCAPSULATED CATHODE HANGER BAR AND METHOD OF MANUFACTURING

FIELD OF THE INVENTION

The present invention relates to deposition cathodes typically used in the refining or winning of metals. In particular, the present invention relates to a deposition cathode assembly comprising a deposition plate and a hanger bar sheathed in a protective cladding wherein the gap between the cladding and the internal welded joint of the deposition plate to the hanger bar is filled thereby encapsulating the weld in a corrosion resistant material and preventing the ingress of corrosive media.

BACKGROUND OF THE INVENTION

Refining or winning of many non-ferrous metals can be achieved by electrolysis. For metals which are more readily oxidised and reduced than water, one electro-refining technique comprises placing an anode fabricated from the crude metal and a cathode together in suitable acid bath. Application of a voltage between the anode and the cathode cause the crude metal to oxidise and pure metal ions to migrate electrolytically through the acid bath to the cathode. The metal ions are deposited on the cathode as a refined metal of high purity, leaving the majority of impurities on the floor of the acid bath. Alternatively, in the electro-winning process the anode is fabricated from a material other than the metal being refined, for example for the electro-winning of copper one anode used is fabricated from an alloy of Lead, Tin and Calcium (Pb, Sn and Ca). The metal to be refined, copper in this case, is delivered to the electrolytic bath in soluble form, primarily from a leaching and solvent extraction process. Application of a voltage across the anode and cathode causes the copper to migrate from the solution and deposit on the cathode in a refined metallic state.

The cathodes are typically comprised of a flat, square deposition plate attached along an upper edge to an electrically conductive hanger bar. The hanger bar, which straddles the tank which houses the acid bath during refining, is in turn in electrical contact with an external power source, conventionally by means of a pair of electrically conductive bus bars which run in parallel along opposite edges of the tank and upon which the ends of the hanger bar rest. The hanger bar therefore serves a dual purpose: providing the means for suspending the deposition plate within the acid bath and providing a path for the flow of electrical current between the deposition plate and the power source.

After a suitable period of time when sufficient copper has migrated from the anode to the cathode, or from soluble (solution) form to the cathode, the cathode is removed from the acid bath. Alternatively, other metals can be used for the fabrication cathodes. In the event one of these metals is used, the refined metal can be extracted by a variety of well known stripping techniques, including scraping, hammering, the use of compressed air, etc. This has the benefit that the cathode can be reused with little or no preparatory work being required other than the removal of previously refined metal.

The prior art reveals a number of cathodes with deposition sheets and other elements fabricated from metals which are different from the metal being refined. Examples of such metals include aluminium, titanium and stainless steel. These metals exhibit a number of qualities which encourage their use as deposition plates, including a relatively high tensile strength and very good corrosion resistance. However, increase in tensile strength and corrosion resistance is typically offset by a decrease in conductivity and therefore a reduction in the efficiency of the process.

The prior art reveals cathode assemblies where the hanger bar is manufactured from the same or similar material as the deposition plate. The hanger bar and the deposition plate are welded together and the hanger bar, weld and a small portion of the deposition plate are then coated in a highly conductive cladding, such as copper, to improve conductivity between the conductive rails and the deposition plate. These prior art cathode assemblies suffer from the drawback that the current flow, and thereby the efficiency of the electrolytic process, is largely limited by the thickness of the conductive cladding. Additionally, the conductive cladding is exposed to the corrosive fluids of the acid bath due to splashing, etc., which can cause pitting and other corrosive effects further reducing the conductivity of the cladding as well as the electrolytic migration of the cladding to the surface of the deposition plate.

In order to address the above and other drawbacks, the prior art reveals alternative assemblies where the hanger bar is manufactured from a highly conductive material with very low internal resistance, such as solid copper, with the deposition plate being attached, typically via a weld, to the hanger bar. Due to the use of dissimilar metals, however, the weld is particularly susceptible to premature galvanic corrosion, and therefore the hanger bar, weld and a small portion of the deposition plate are sheathed in a suitably formed and snugly fitting cladding of the same or similar material as the deposition plate. The edges of the cladding are then welded to the deposition plate thereby protecting the hanger bar to some degree from the effects of the corrosive contents of the electrolytic bath. Additionally, as the hanger bar is used to haul the deposition plate out of acid bath on completion of the deposition process, which can leave a considerable mass of metal deposited on the deposition plate, the cladding also provides the added benefit of strengthening the assembly.

A major drawback, however, of the above prior art assembly is that corrosive liquid typically escapes from the acid bath, circumvents the weld between the shroud and the deposition plate and penetrates the joint between the hanger bar and the deposition plate. This leads to electrolytic migration of the metals and corrosion of the joint, thereby reducing the conductivity of the assembly and the efficiency of the unit as a whole. Additionally, as the joint is hidden behind the cladding, washing to remove the corrosive electrolyte is difficult if not impossible and therefore the effects of the corrosive liquid are difficult to arrest.

SUMMARY OF THE INVENTION

The present invention addresses the above and other drawbacks by providing a cathode for use in the refining of metals. The cathode comprises a substantially flat deposition plate fixedly attached along an upper edge thereof to an elongate hanger bar thereby defining a connection. A protective cladding abuts the deposition plate and at least partially surrounds the hanger bar such that a cavity is defined in the region of the connection. A corrosion resistant material is used to fill the cavity. The corrosion resistant material prevents corrosive substances from penetrating the connection.

There is also provided a method for fabricating a cathode assembly for use in the refining of metals. The cathode is of the type comprising a deposition plate for electrodepositing metals. The method comprises the steps of:

(a) providing a substantially flat deposition plate having an upper edge;

(b) fastening an elongate hanger bar on the upper edge of the deposition plate, thereby providing a deposition plate assembly;

(c) securing a protective cladding to the deposition plate assembly so as to substantially overlay the area of securement between the hanger bar and the upper edge of the deposition plate, thereby defining a fillable cavity between the cladding and the deposition plate assembly; and (d) filling the cavity with a corrosion resistant material thereby providing a fabricated cathode assembly.

DETAILED DESCRIPTION OF THE ILLUSTRATIVE EMBODIMENTS

The illustrative embodiments of according to the present invention will now be described.

Figure 1:
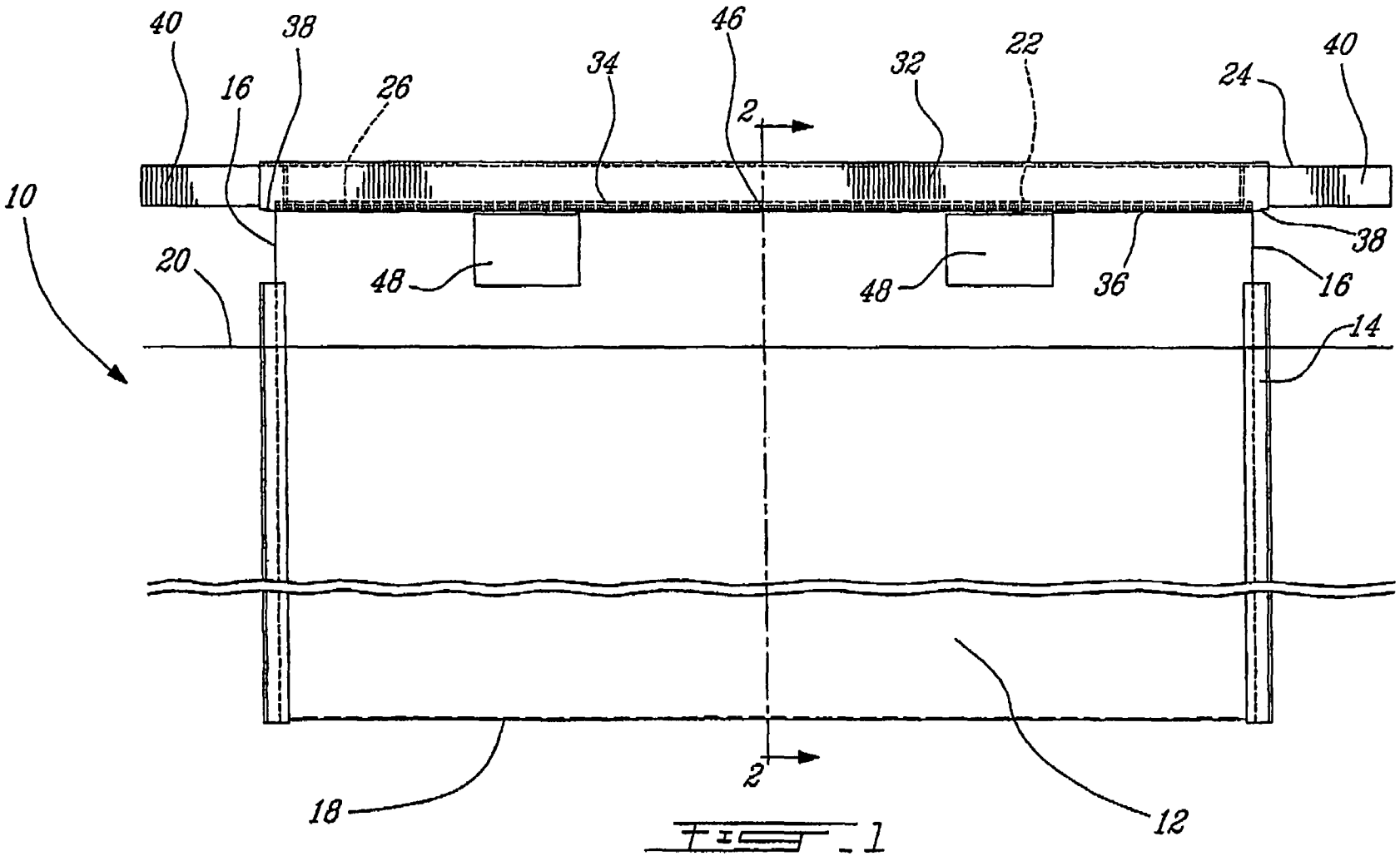
FIG. 1 is a side elevation view of a cathode in accordance with an illustrative embodiment of the present invention.

Referring to FIG. 1, there is illustrated a cathode assembly generally indicated by the numeral 10. The cathode assembly 10 is comprised of a substantially square deposition plate 12 manufactured from an electrically conductive material having a relatively high tensile strength and good corrosion resistance. In an illustrative embodiment AISI type 316L austentic stainless steel of approximately 3.25 mm thickness is used to fabricate the deposition plate 12 with the surface of the deposition plate 12 being preferably finished to ASTM A480, Type 2B, with 0.16 to 0.60 microns of roughness.

In order to prevent creep of copper deposited on the surface of the deposition plate 12 around the edges, which can lead to the mechanical separation of the deposited copper (not shown) from the surface of the deposition plate 12, a pair of edge-strips as in 14 are attached along the edges 16 of the deposition plate 12 extending from the lower edge 18 to a point above the maximum level of the electrolyte 20 into which the deposition plate 12 is dipped. The edge-strips 14 are manufactured from a non-conductive material, for example polypropylene, and provide a seal against the ingress of electrolyte and copper onto the side edges 16. Prior to installation of the edge-strips 14 a self adhesive sealing gasket tape (not shown) is installed onto the side edges 16 to further improve the seal.

Figure 2:
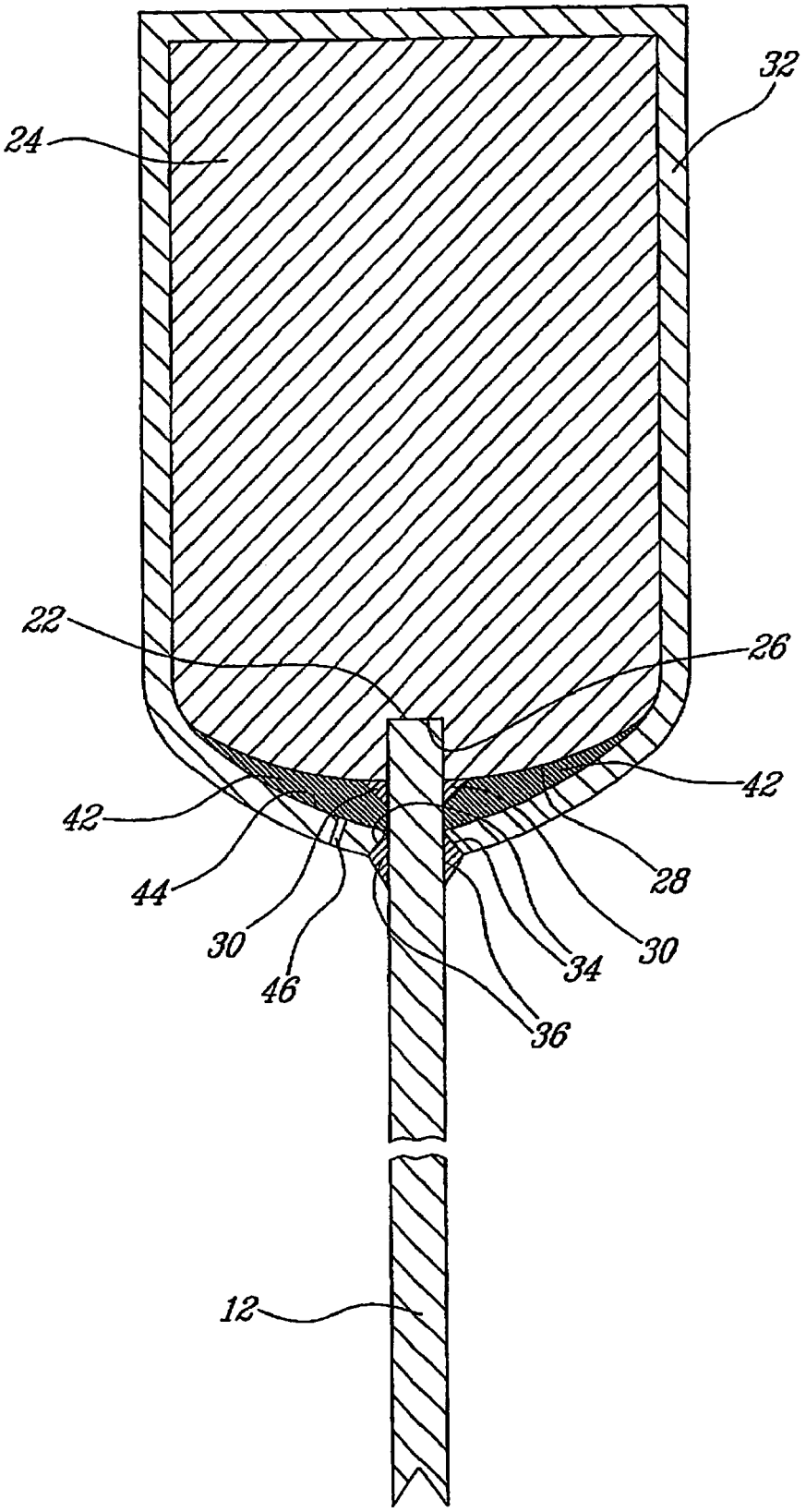
FIG. 2 is a cross-sectional view along 2-2 in FIG. 1 of a cathode in accordance with an illustrative embodiment of the present invention.

Referring to FIG. 2, the upper edge 22 of the deposition plate 12 is attached to a copper hanger bar 24 by first inserting the deposition plate 12 into a slot 26 machined in the lower surface 28 of the copper hanger bar 24. The deposition plate 12 is then welded to the copper hanger bar 24 using known TIG welding techniques. In this manner a first pair of seam welds as in 30 are formed on both surfaces and along the entire breadth of the deposition plate 12 at the point where the surfaces of the deposition plate 12 meet the lower surface of the hanger bar 24.

In an alternative embodiment the upper edge 22 of the deposition plate is not inserted in a slot but rather butts against the lower surface 28 of the hanger bar 24.

The hanger bar 24 is manufactured from an unalloyed solid copper of a high purity, such as electrolytic tough pitch copper with the UNS (Unified Numbering System) designation C11000, and the first pair of seam welds 30 serve primarily to provide for good conduction of electrical current between the deposition plate 12 and the copper hanger bar 24.

Referring back to FIG. 1 in addition to FIG. 2, the hanger bar 24, the upper edge 22 of the deposition plate 12 and the first pair of seam welds 30 are encapsulated in an elongate stainless steel cladding 32, the cladding 32 manufactured from an AISI type 316 stainless steel sheet of 1.5 mm thickness. The cladding 32 is suitably formed and includes a clearance fit such that it may be slid freely over the hanger bar/deposition plate assembly following seam welding of the hanger bar 24 to the deposition plate 12.

Once positioned over the hanger bar 24 and deposition plate 12, the lower edges 34 of the cladding 32 are welded onto the surfaces of the deposition plate 12. The welding results in the deposition of a second pair of seam welds 36 along the entire breadth of the deposition plate 12 immediately below the first pair of seam welds 30. The cladding 32 and second pair of seam welds 36 provide the dual purpose of re-enforcing the hanger bar 24 as well as providing some protection against the ingress of corrosive electrolyte solution and other liquids onto the first pair of seam welds 30 and into the joint between the upper edge 22 of the deposition plate 12 and the lower surface 28 of the hanger bar 24. Additionally, the lower edges towards the ends 38 of the cladding 32 are joined and welded together.

Referring to FIG. 1, as stated above, during the electro-refining process the deposition plate 12 is dipped in the electrolyte bath (not shown) up to an approximate level indicated by the numeral 20. The deposition plate is supported at this level by the ends 40 of the copper hanger bar 24 which rest on a pair of electrically conductive bus bars running in parallel along opposite edges of the tank (all not shown) containing the electrolyte bath. As a considerable mass of metal can be deposited on the deposition plate 12 during the electro-refining process (up to 200 kg or more on a 1 m square sheet), a considerable force can be brought to bear on the joint between the deposition plate 12 and the copper hanger bar 24. The re-enforcement alleviates much of the stress which would otherwise be exerted on the first pair of seam welds 30 by the mass of deposited metal, thereby reducing the possibility that the first pair of seam welds 30 are broken or otherwise cracked, thereby reducing conductivity. This in turn improves the robustness and reliability of the cathode assembly 10 and as a result its useful life.

Referring back to FIG. 2 in addition to FIG. 1, although once welded into place the cladding 32 provides some protection against the ingress of corrosive electrolyte solution onto the first pair of seam welds 36, the seal provided by the second pair of seam welds 36 is not hermetic. Therefore, if left unchecked the potential exists that corrosive electrolyte solution or other liquids will eventually penetrate the second pair of seam welds and detrimentally effect the join between hanger bar 24 and the deposition plate 12. This problem is exacerbated by the unavoidable wear and tear which arises from the repeated insertion and extraction of the cathode assembly 10 from the electrolyte bath (not shown) as well as the removal of refined metals from the deposition plate 12 and the washing and refinishing of the surfaces of the deposition plate 12 prior to its reinsertion into the electrolyte bath. Therefore, to provide additional protection against the ingress of corrosive solution or other liquids beneath the cladding 32, a corrosion resistant sealant 42, for example an epoxy resin, is injected into a space created between the lower surface 28 of the hanger bar 24 and the inside surface 44 of the cladding 32. This insures that the electrical conductivity between the copper hanger bar 24 and the deposition plate 12 provided for by the first pair of seam welds 30 is maintained throughout an extended period of time.

Typically, the corrosion resistant material 42 is injected by boring small holes as in 46 in the protective cladding 32. The corrosion resistant material 42 in a free flowing form is then injected into the space between the lower surface of the copper hanger bar 24 and the inside surface 44 of the cladding 32 along the entire length of the cladding 32. The corrosion resistant material 42 then hardens forming a hermetic seal around the first pair of seam welds 30.

Referring now to FIG. 1, as stated above during the refining process a considerable mass of metal can be deposited on the deposition plate 12. Therefore, in order to assist in the automated extraction of the cathode assembly 10 from the electrolyte tank (not shown) a pair of rectangular slots as in 48 are machined through the deposition plate 12 at a point immediately below the second pair of seam welds 36. Hooks (not shown) or other lifting devices, such as the tines of a fork lift, can be inserted in the slots 48 and the cathode assembly raised.

Although the present invention has been described hereinabove by way of a preferred embodiment thereof, this embodiment can be modified at will, within the scope of the present invention, without departing from the spirit and nature of the subject of the present invention.

What is claimed is:

1. A cathode assembly for use in the refining of metals, comprising:

a substantially flat deposition plate fixedly attached along an upper edge thereof to an elongate hanger bar thereby defining a connection;

a protective cladding abutting said deposition plate and at least partially surrounding said hanger bar such that a cavity is defined in the region of said connection; and a curable corrosion resistant material filling said cavity.

2. The cathode assembly as recited in claim 1, wherein said deposition plate is attached to said hanger bar by means of at least one weld.

3. The cathode assembly as recited in claim 1, wherein said protective cladding is performed.

4. The cathode assembly as recited in claim 1, wherein said corrosion resistant material is an epoxy resin.

5. The cathode assembly as recited in claim 1, wherein said deposition plate and said cladding are fabricated from stainless steel.

6. The cathode assembly as recited in claim 1, wherein said cladding is attached to said deposition plate by means of at least one welcL

7. The cathode assembly as recited in claim 1, wherein an inverted v-profile is machined in a lower edge of said deposition plate.

8. A method for fabricating a cathode for use in the refining of metals, said cathode being of the type comprising a deposition plate for electrodepositing metals, said method comprising the steps of:

(a) providing a substantially flat deposition plate having an upper edge;

(b) fastening an elongate hanger bar on said upper edge of said deposition plate, thereby providing a deposition plate assembly;

(c) securing a protective cladding to said deposition plate assembly so as to substantially overlay the area of fastening between said hanger bar and said upper edge of said deposition plate, thereby defining a cavity between said cladding and said deposition plate assembly; and (d) filling said cavity with a corrosion resistant material thereby providing a fabricated cathode.

9. The method for fabricating a cathode as in claim 8, wherein said fastening step includes welding said upper edge to said hanger bar.

10. The method for fabricating a cathode as in claim 8, wherein said filling step comprises boring at least one hole in said protective cladding and injecting a liquid phase of said corrosion resistant material into said cavity, said corrosion resistant material subsequently hardening into a solid phase.

11. The method for fabricating a cathode as in claim 10, wherein said corrosion resistant material is an epoxy resin.

12. The method for fabricating a cathode as in claim 8, wherein said attaching step comprises welding said cladding to said deposition plate by means of at least one weld.

* * * * *